US005461414A

United States Patent [19]

Honda et al.

[11] Patent Number: 5,461,414

[45] Date of Patent: Oct. 24, 1995

[54] METHOD AND APPARATUS FOR CONTROLLING A SCANNING BEAM OF AN OPTICAL SCANNING DEVICE

[75] Inventors: Ryoji Honda; Satoshi Takami, both of Saitama, Japan

[73] Assignee: Asahi Kogaku Kogyo Kabushiki Kaisha, Tokyo, Japan

[21] Appl. No.: 45,202

[22] Filed: Apr. 13, 1993

[30] Foreign Application Priority Data

Apr. 16, 1992 [JP] Japan ..... 4-124138

[51] Int. Cl.[6] ..... B41J 2/435

[52] U.S. Cl. ..... 347/250

[58] Field of Search ..... 346/108, 107 R, 346/76 L, 160, 1.1; 347/235, 250, 248, 234

[56] References Cited

U.S. PATENT DOCUMENTS 4,897,675 1/1990 Negishi .

4,918,306 4/1990 Saito .

4,933,549 6/1990 Fujioka et al. ..... 250/235

*Primary Examiner*—Mark J. Reinhart

*Attorney, Agent, or Firm*—Sandler, Greenblum & Bernstein

[57] ABSTRACT

An optical scanning device emits a scanning laser beam which scans a photoconductive material, and a detection device located upstream with respect to the scanning direction of the laser beam. The laser beam is first emitted to scan the detection device, and the reception of the laser beam is detected by the detection device. The emission of the laser beam is terminated as soon as the detection device first detects the reception of the laser beam. A scanning laser beam modulated with image information is then emitted to scan the photoconductive material.

16 Claims, 3 Drawing Sheets

METHOD AND APPARATUS FOR CONTROLLING A SCANNING BEAM OF AN OPTICAL SCANNING DEVICE

BACKGROUND OF THE INVENTION

The present invention relates to an optical scanning device to be used in a laser beam printer and the like.

In an laser beam printer, an optical scanning device emits a laser beam that is modulated with print information. More specifically, in the laser beam printer, a laser diode is switched ON and OFF in accordance with data representing the print information. The laser beam emitted by tile laser diode is deflected by a polygonal mirror towards a circumferential surface of a photoconductive drum so as to scan it.

In the optical scanning device, an unmodulated laser beam is emitted and then detected by a detection means to establish a starting reference for the scanning of the photoconductive drum by a modulated laser beam. Thus, a light receiving element of the detection means, such as a photo sensor, is provided on the upstream side of the photoconductive drum with respect to the scanning direction. The light receiving element receives the unmodulated laser beam and adjusts the starting reference used for the emission of the modulated laser beam. The emission of the modulated laser beam is then started a predetermined period after the reception of the laser beam by the light receiving element of the detection means.

The detection means outputs a detection signal when it receives the laser beam. In a conventional optical scanning device, the emission of the unmodulated laser beam is terminated after the output of the detection signal is finished.

Also, in a conventional optical scanning device, there is a delay between the reception of the laser beam by the detecting means and the output of the detection signal as a result of the response characteristics of the circuitry of the light detecting device.

Thus, in the conventional optical scanning device, the laser beam received by the detection means and used to establish the starting reference for the modulated laser beam, keeps emitting light even after it has passed the light receiving area of the detection means.

If such an optical scanning device as employed in a high-speed scanning type laser beam printer, an imaging area of the circumferential surface of the photoconductive drum may be scanned which should not have been scanned. If the photoconductive drum is exposed to the laser beam as above, a latent image is formed, and developed in the developing process. Accordingly, for example, a belt-like image would be printed on a recording sheet.

If an out-of-imaging area of the photoconductive drum is scanned, the additional image, such as the belt-like image, would not be printed on the recording Sheet. However, since the latent image is formed on the out-of-imaging area, and therefore a toner image is formed on the photoconductive drum, toner is wasted, the efficiency of the cleaning function for the circumferential surface of the photoconductive drum is reduced, and the possibility of dirt inside the printer is increased.

SUMMARY OF THE INVENTION

It is therefore an object of the present invention to provide an improved optical scanning device which can prevent the laser beam from being emitted towards a photoconductive material which is not to be scanned.

For the above objective, according to the invention, there is provided an optical scanning device, comprising:

means for emitting a first scanning laser beam towards an object to be scanned;

means for emitting a second scanning laser beam prior to a emission of the first scanning laser beam;

means for detecting the second scanning laser beam; and means for disabling the means for emitting the second scanning laser beam as soon as the detecting means detects a reception of the second scanning laser beam.

Optionally, the optical scanning device includes means for enabling the means for emitting a second scanning laser beam after the emission of the first scanning laser beam is completed.

Further, the first scanning laser beam is emitted a predetermined period after the detection device first detects an reception of the second scanning laser beam.

According to another aspect of the invention, there is provided a method of driving an optical scanning device to emit a scanning laser beam which scans:

(1) a photoconductive material to be exposed to a laser beam modulated with image information; and (2) a detection device located upstream with respect to the scanning direction of the laser beam, the detection method comprising the steps of:

emitting a laser beam to scan the detection device;

detecting the initial reception of the laser beam with the detection device;

terminating an emission of the laser beam as soon as the detection device detects a reception of the laser beam; and emitting a laser beam modulated with image information to the photoconductive material.

According to a further aspect of the invention, there is provided a method of driving an optical scanning device to emit a scanning laser beam, comprising the steps of:

emitting a first scanning laser beam to a detection device;

detecting an initial reception of the first scanning laser beam with a detection device;

disabling an emission of the first scanning laser beam as soon as the reception of the scanning laser beam is first detected; and emitting a second scanning laser beam modulated with predetermined information.

DESCRIPTION OF THE ACCOMPANYING DRAWINGS

DESCRIPTION OF THE EMBODIMENTS

Figure 3:
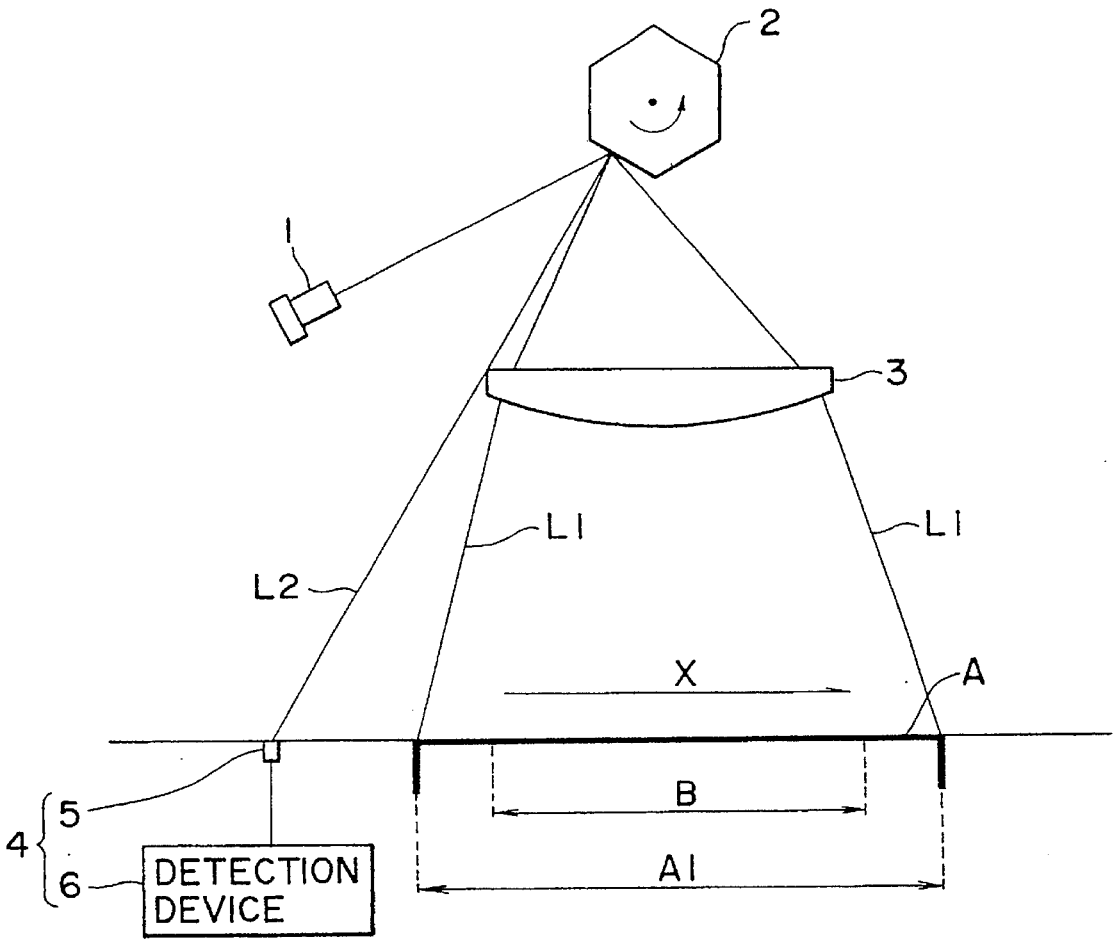
FIG. 3 is a top view showing a schematic construction of an optical scanning device according to the present invention.

FIG. 3 is a top view showing a schematic construction of an optical scanning device adapted in a laser beam printer.

In the optical scanning device shown in FIG. 3, a laser diode 1 is driven in accordance with an active low video signal which is generated in accordance with image information inputted from an external apparatus, such as a host computer. The laser diode 1 emits a laser beam modulated by the video signal. A modulated laser beam is deflected by a polygonal mirror 2 so as to scan the circumferential surface of a photoconductive drum A in a direction indicated by the letter X.

As shown in FIG. 3, the deflected laser beam first enters a light detecting device 4 as indicated by line L2 in order to adjust the timing when the laser diode 1 is modulated by the image information. Then, by way of the fθ lens 3, an deflected laser beam scans the circumferential surface A1 of the photoconductive drum A, i.e., the main scanning is performed by the laser beam L1 modulated with the image information. Hereinafter, the laser beam L1 modulated with the image information will be referred to as an imaging laser beam, and the laser beam L2 received by the detecting means to establish the scanning position of the imaging laser beam will be referred to as a position detecting laser beam.

Figure 2:
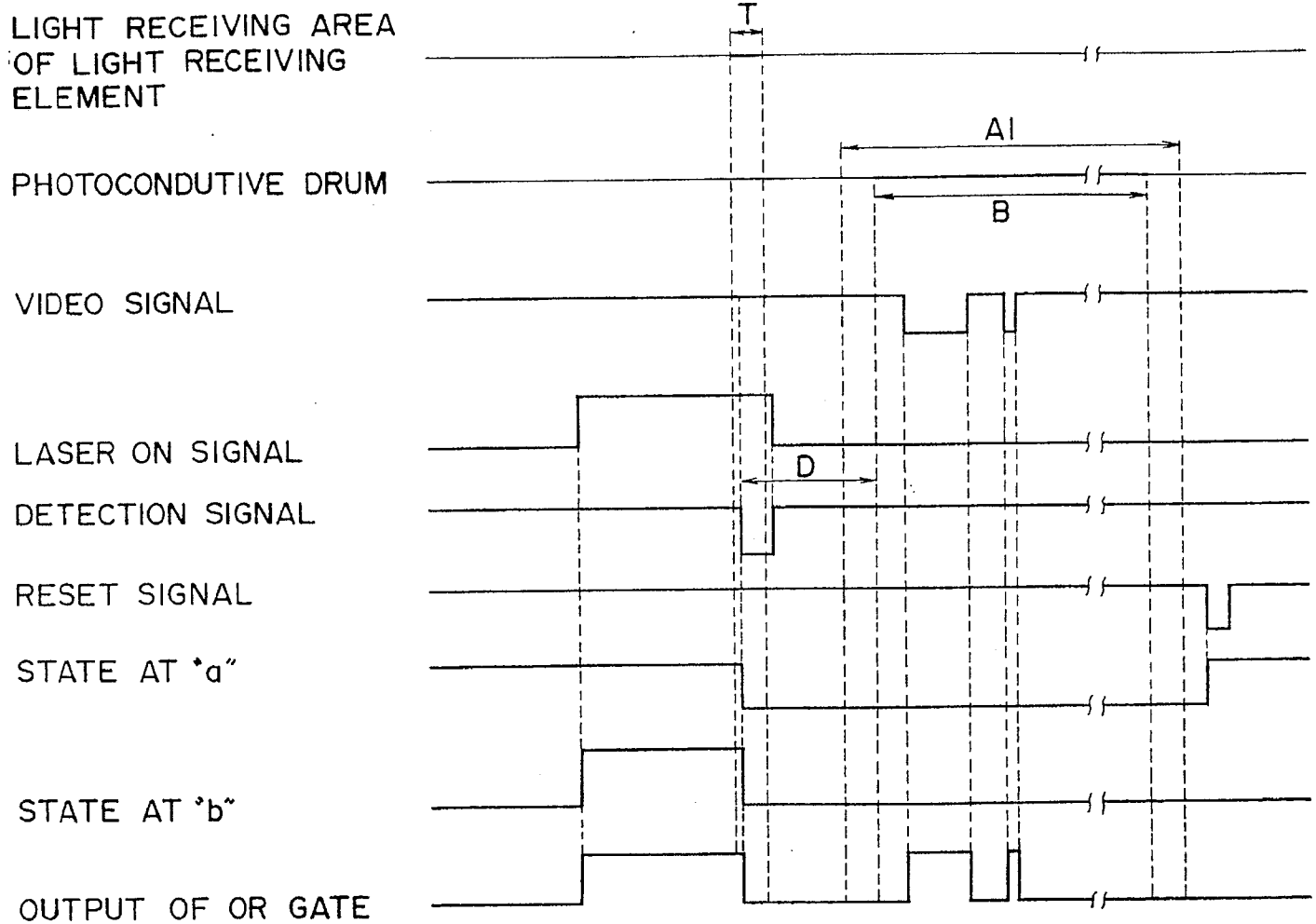
FIG. 2 is a timing chart showing states of signals at various points in the circuit shown in FIG. 1.

As shown in FIG. 2, a detection device 6 outputs an active low detection signal upon an initial reception of the position detection laser beam L2 by the light receiving element 5.

Figure 1:
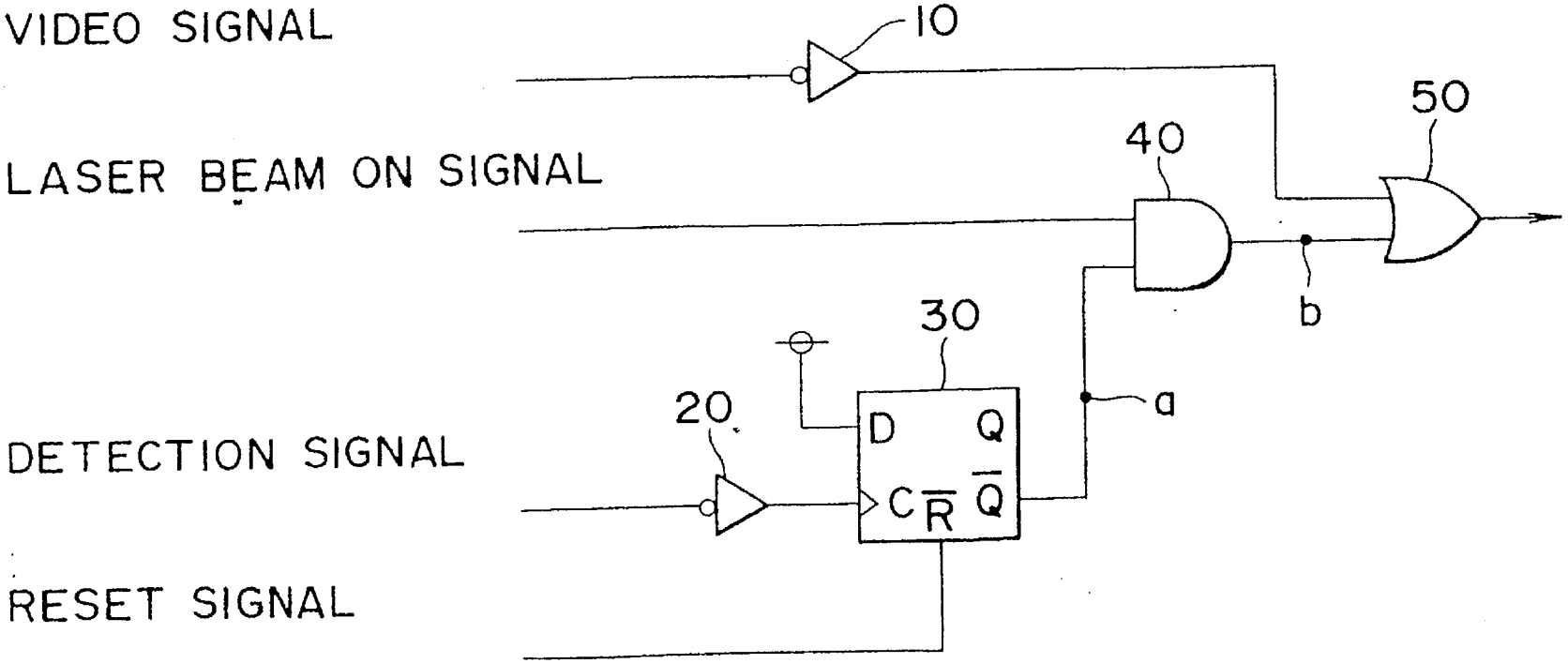
FIG. 1 shows a circuit adapted to control a laser diode to emit a laser beam.

FIG. 1 shows an example of a laser controlling circuit embodying the present Invention. The video signal is applied to the inverter 10. The active low detection signal outputted by the detection device 6 is applied to the inverter 20. The output of a inverter 20 is applied to a D flip-flop circuit 30 as a clock signal. In this circuit, input D is set to "H" (high level).

An inverted Q output of the flip-flop 30 is applied to one of the inputs of AND gate 40. The laser beam ON signal is applied to the other input of the AND gate 40. The laser beam ON signal is used for controlling the emission of the position detection laser beam L2. The output of the AND gate 40 is used for actuating the laser diode 1 to emit the position detection laser beam L2.

The video signal, as shown in FIG. 2, becomes "L" (low) when the laser diode 1 is to be driven to emit the imaging laser beam L1. The laser beam ON signal applied to the AND gate 40 becomes "H" (high) when the laser diode 1 is driven to emit the position detection laser beam L2.

The detection signal applied to the inverter 20 becomes "L" (low) as soon as the position detection laser beam L2 is first detected by the detection device 4. The reset signal applied to the flip-flop 30 is made "L" (low) to reset flip-flop 30. Thus, the reset signal is made low at the end of every scan so as to reset the flip-flop.

Also in FIG. 2 are shown:

- a period T during which the laser beam scans the light receiving area of the light receiving device 5;
- a period A1 during which the laser beam scans the photoconductive drum A; and
- a period B during which the laser beam scans the imaging area of the photoconductive area.

Further illustrated are, the signal at the point "a" in FIG. 1, which is the output of the flip-flop 30; the signal at the point "b", which is the output of the AND gate 40; and the output of the OR gate 50.

The timing chart of FIG. 2 will be described in detail below.

At the beginning of the operation of the optical scanning device, since printing is not yet required, the light detection device 4 outputs a "H" (high) signal. The "H" signal is inverted by the inverter 20, and a "L" (low) signal is applied to the clock input of the flip-flop 30. In this condition, the signal at the point "a" in the laser controlling circuit (i.e., the output of the flip-flop 30) is in the "H" (high) state.

Also, at this stage, since the laser beam ON signal is in the "L" (low) state, the signal at the point "b" in the laser controlling circuit (i.e., the output of the AND gate 40) is in the "L" (low) state. Then, since the video signal is in the "H" (high) state, the inverter 10 outputs a "L" (low) signal, an OR gate 50 outputs a "L" (low) signal, and therefore, the laser diode 1 is not driven.

In the next step, printing is required. At first, the state of the laser beam ON signal is changed from "L" to "H" in order to generate the position detecting laser beam used to determine the starting reference for the imaging laser beam. The light detection device 4 still outputs the "H" signal. Thus, point "a" remains in the "H" state. The signal at point "b" then changes from "L" to "H". Accordingly the output of the OR gate 50 changes from "L" to "H". Since the OR gate 50 outputs the "H" (high) signal, the laser diode 1 is driven to emit the laser beam, i.e., the position detection laser beam L2.

The position detection laser beam is deflected by the polygonal mirror 2 and thus scans along the direction X. As soon as the light receiving element 5 of the light receiving device 4 receives the scanning position detection laser beam L2, the detection device 4 outputs a "L" (low) signal. Since the output of the detection device 4 changes from the "H" signal to the "L" signal, the inverter 20 outputs the "H" signal which is applied to the clock input of the flip-flop 30. Upon input of the "H" signal to the clock input, the flip-flop 30 outputs the "L" signal. The state at point "b" will then change from the "H" state to the "L" state and the output of the OR gate 50 will change from "H" to "L". Thus, the emission of the position detection laser beam L2 is terminated. This termination of the position detection laser beam occurs as the detection signal changes from the high to low state (i.e., as soon as the position detection beam is received by the detection means) as shown by the timing diagram of FIG. 2. In other words, the laser emitting means is controlled in such a manner that it is turned off immediately after the detecting means has commenced detection of the position laser beam. Thus, the position detection beam is no longer emitted and therefore, exposure of the photoconductive drum by this beam will not occur. When a period D has passed since the detection signal was outputted, the scanning position reaches the imaging area B, and it becomes possible to emit the imaging laser beam L1.

After the emission of the position detection laser beam L2 has been terminated, the state of the signal at point "b" remains "L" until the reset signal is applied to the flip-flop 30. Accordingly, even if the output of inverter 20 is changed from "L" signal to "H" signal, the point "a" remains in the "L" state, and therefore point "b" is kept in the "L" state.

Therefore, for the remainder of the scan, the laser diode 1 is driven only when the output of the inverter 10 is in the "H" state (i.e., the video signal is in the "L" state).

The emitted laser beam is deflected by the polygonal mirror 2 towards the photoconductive drum A so that the imaging laser beam L1 scans the imaging area B of the circumferential surface of the photoconductive drum A along the main scanning direction X. This is a well known process and will not be described here.

After one scan is completed, the reset signal is applied to the flip-flop 30. Accordingly, the state of point "a" changes from "L" to "H". The scan process can then be repeated.

As described above, with the laser controlling circuit shown in FIG. 1, the position detection laser beam is terminated as soon as the detection device 4 changes from the high to the low state. Thus, according to this laser controlling circuit, it becomes possible to terminate the emission of the position detection laser beam sooner (by time period T as shown in FIG. 2) than achieved with the conventional optical scanning device, in which the emission of the position detection laser beam is terminated at the end of the detection signal (i.e., changing from the low to high state).

Accordingly, with the optical scanning device of the present invention, the emission of the position detection laser beam will be terminated before it scans the photoconductive drum, even in a high-speed laser beam printer. Thus, it becomes possible to prevent the printing of unintentional belt-like or linear images due the action of the position detection laser beam.

Further, according to the optical scanning device embodying the present invention, the position detection laser beam does not even scan the non-imaging area A1 of the photoconductive drum A. Thus, the efficiency of a cleaning operation can be improved. Furthermore, it becomes possible to prevent the laser beam printer from becoming dirty due to the toner being stuck to the non-imaging area of the photoconductive drum A.

The end of the detection signal outputted by the detection device 4 may vary depending on the intensity of the laser beam, ambient temperature, and so on. With the optical scanning device embodying the present invention, since the emission of the position detection laser beam is terminated at the time when the detection device 4 first detects the position detection laser beam, a stable operation can be guaranteed.

In the above-described embodiment, the emission of the position detection laser beam is terminated as soon as the detection device 4 first detects the laser beam. However, the present invention can be modified such that the emission of the position detection laser beam is terminated a predetermined period after the detection of the laser beam.

The circuit is not limited to that shown in FIG. 1, but various types of circuits can be used as far as it functions in the same manner. Further, an addition and/or deletion of AND gates, OR gates, and so on can be made depending upon the constitution of the respective optical scanning devices to which the present invention is applied.

The present disclosure relates to subject matter contained in Japanese Patent Application No. HEI 4-124138, filed on Apr. 16, 1992, which is expressly incorporated herein by reference in its entirety.

What is claimed is:

1. An optical scanning device, comprising:

means for emitting a first scanning laser beam towards an object to be scanned;

means for emitting a second scanning laser beam prior to an emission of said first scanning laser beam;

means for detecting said second scanning laser beam; and means for disabling said means for emitting a second scanning laser beam in response to a state change of a detection signal output by said detecting means when said second scanning laser beam is first detected.

2. The optical scanning device according to claim 1, wherein said object comprises a photoconductive material.

3. The optical scanning device according to claim 2, wherein said first scanning laser beam is modulated with image information that forms a latent image on said photoconductive material.

4. The optical scanning device according to claim 1, wherein said first and said second scanning laser beams are emitted within one scanning cycle.

5. The optical scanning device according to claim 1, further comprising means for enabling said means for emitting a second scanning laser beam after said emission of said first scanning laser beam is completed.

6. The optical scanning device according to claim 1, wherein said first scanning laser beam is emitted a predetermined period of time after said detection device detects a reception of said second scanning laser beam.

7. The optical scanning device according to claim 1, wherein said means for emitting a first scanning laser beam and said means for emitting a second scanning laser beam comprise a same emitting means.

8. A method of driving an optical scanning device to emit a scanning laser beam which scans a photoconductive material to be exposed to a laser beam modulated with image information, and a detection device located upstream with respect to a scanning direction of the laser beam, the method comprising the steps of:

emitting a laser beam to scan the detection device;

detecting a reception of the laser beam with the detection device;

terminating an emission of the laser beam in response to a state change of a detection signal output by the detection device when the laser beam is first detected; and emitting a laser beam modulated with image information to scan the photoconductive material.

9. A method of driving an optical scanning device to emit a scanning laser beam, comprising the steps of:

emitting a first scanning laser beam to a detection device;

detecting an incidence of the first scanning laser beam with the detection device;

disabling an emission of the first scanning laser beam in response to a state change of a detection signal output by the detection device when the first scanning laser beam is first detected; and emitting a second scanning laser beam modulated with predetermined information.

10. An optical scanning device, comprising:

means for emitting a laser beam;

means for modulating said emitting means;

means for deflecting said laser beam emitted by said emitting means to scan a predetermined area of a photoconductive member;

means for detecting said laser beam at a position that is located out of said predetermined area to determine a timing when a modulation of said emitting means is commenced; and means for controlling said emitting means in such a manner that said emitting means is turned off in response to a state change of a detection signal output by said detecting means when said laser beam is first detected.

11. An optical scanning device, comprising:

an emitter that emits a laser beam to a surface to be scanned, said laser beam comprising:
a position detecting laser beam; and
an imaging laser beam;

a detector that detects said position detecting laser beam to adjust a timing at which said imaging laser beam is to be modulated with a predetermined signal; and a terminating device that disables said position detecting laser beam, until a predetermined event occurs, in response to a state change in a detection signal output by said detector when said position detecting laser beam is first detected, in order to prevent a scanning of said surface by said position detecting laser beam.

12. The optical scanning device of claim 11, wherein said surface to be scanned comprises a photoconductive drum.

13. The optical scanning device of claim 12, wherein said predetermined signal comprises a modulated video signal, said imaging laser beam being modulated with said video signal to form a latent image on said photoconductive drum.

14. The optical scanning device of claim 11, wherein said imaging laser beam is emitted after said position detecting laser beam has been detected by said detector.

15. A method of driving an optical scanning device to emit a scanning laser beam, comprising the steps of:

emitting a scanning laser beam formed of a position detecting laser beam and an imaging laser beam towards a surface to be scanned;

detecting the position detecting laser beam with a detector to adjust a timing at which the imaging laser beam is to be modulated with a predetermined signal; and disabling the position detecting laser beam, until a predetermined event occurs, in response to a state change in a detection signal output by the detector when the position detecting laser beam is first detected, in order to prevent a scanning of the surface by the position detecting laser beam.

16. The method of claim 15, wherein the emitting step comprises emitting the scanning laser beam emits towards a surface of a photoconductive drum.

* * * * *